United States Patent [19]

Holland et al.

[11] 4,399,902

[45] Aug. 23, 1983

[54] COIN-HANDLING ESCROW ASSEMBLY

[75] Inventors: Charles R. Holland; Carl L. Vogt, both of St. Louis, Mo.

[73] Assignee: Coin Acceptors, Inc., St. Louis, Mo.

[21] Appl. No.: 185,753

[22] Filed: Sep. 10, 1980

[51] Int. Cl.[3] ..... G07F 9/04

[52] U.S. Cl. ..... 194/1 D; 194/DIG. 28

[58] Field of Search ..... 194/1 C, 1 D, DIG. 15, 194/DIG. 28, DIG. 29

[56] References Cited

U.S. PATENT DOCUMENTS 2,311,751 2/1943 Hoyt ..... 194/1 C

*Primary Examiner*—Stanley H. Tollberg

*Attorney, Agent, or Firm*—Cohn, Powell & Hind

[57] ABSTRACT

A coin-handling assembly including a coin escrow station for receiving coins of one denomination, and an escrow-actuator selectively retaining the coins in the escrow station, and selectively releasing the coins individually from the escrow station. The escrow actuator includes first and second fingers selectively movable into and out of the path of the coins in the escrow station, and an actuator selectively moving the first finger into engagement with a lowermost coin, and the second finger out of engagement with the coins for holding the coins in the escrow station. The actuator selectively moves the first finger out of engagement with the lowermost coin for releasing the lowermost coin for delivery to the coin-diverter, and selectively moves the second finger into engagement with a next adjacent coin for holding the remaining coins in the escrow station while the first finger releases the lowermost coin. Further, the actuator selectively moves the second finger out of engagement with the coins, and selectively moves the first finger into the path of the coins after release of the lowermost coin for allowing the next adjacent coin to move and engage the first finger.

6 Claims, 6 Drawing Figures

COIN-HANDLING ESCROW ASSEMBLY

BACKGROUND OF THE INVENTION

This invention relates generally to a coin-handling assembly, and more particularly to an improved assembly for receiving coins of one denomination in a coin escrow station, and then delivering these coins selectively and individually from the escrow station to either a coin return or a cash box.

In heretofore conventional coin-handling assemblies utilized in vending machines, all of the valid coins were accepted and deposited in the cash box when the vend operation is instituted, and any change that was required was returned to the user from the supply of change held in coin storage tubes. In some instances, such coin-handling assemblies will accept all valid coins and return coins from the coin storage tubes to the user through the coin return in the event the user does not vend the product but rather desires the return of money upon actuation of the coin return mechanism. In any event, it will be understood that the use of these prior coin-handling assemblies resulted in an undesirable depletion of coins stored primarily for making change.

SUMMARY OF THE INVENTION

The present coin-handling assembly will hold coins of one denomination in escrow until the user actuates the vending operation or actuates the coin return. If the coin return is actuated by the user, all of the coins that were held in escrow are returned to the user, and none of the coins held in change storage tubes are dispensed. If the vend operation is instituted, the coins held in escrow will be delivered to the cash box and only change required to meet the value of one of such coins is delivered to the user from coin storage tubes. If there is remaining any such coin in the escrow station having a value more than that value for which change is returned, that coin held in escrow is returned to the user as an overpayment. Again, it will be understood that the coins inserted by the user and held in the escrow station of the coin-handling assembly, and not needed to complete the vend operation, are returned to the user rather than returning coins held for change in coin storage tubes.

The coin-handling assembly includes a coin escrow station for receiving coins of one denomination, and escrow-actuating means selectively retaining the coins in the escrow station, and selectively releasing the coins individually from the escrow station. A coin-diverting means selectively engages each coin when released from the escrow station, and selectively directs each coin to either a coin return means or a cash box means.

In one aspect of the invention, the escrow-actuating means includes first and second fingers selectively movable into and out of the path of the coins in the escrow station, and an actuator means selectively moving the first finger into engagement with a lowermost coin, and a second finger out of engagement with the coins for holding all of the coins in the escrow station. The actuator means selectively moves the first finger out of engagement with the lowermost first coin for releasing the lowermost first coin for delivery to the coin-diverting means, and selectively moving the second finger into engagement with a next adjacent second coin for holding the second coin and any successive coins in the escrow station while the first finger releases the lowermost first coin.

In another aspect of the invention, the actuator means selectively moves the second finger out of engagement with the second coin, and selectively moves the first finger into the path of the second coin after release of the lowermost first coin for allowing the next adjacent second coin to move to and engage the first finger.

In another aspect of the invention, the coin-diverting means of the coin-handling assembly includes a first passage connecting the escrow station to the cash box means, and a second passage connecting the escrow station to the coin return means. A coin-diverting member between the escrow station and each of the first and second passages is movably mounted for movement to a first position for diverting a coin from the escrow station to the first passage, and for movement to a second position for diverting a coin from the escrow station to the second passage.

In another aspect of the coin-handling assembly, the coin-diverting member includes a shoulder for deflecting a coin from the escrow station to one of the passages, and a chute for receiving and delivering a coin from the escrow station to the other passage, for delivery selectively to either the cash box means or coin return means. An actuator means connected to the coin-diverting member selectively moves the coin-diverting member to the first and second positions.

DESCRIPTION OF THE PREFERRED EMBODIMENT

Figure 1:
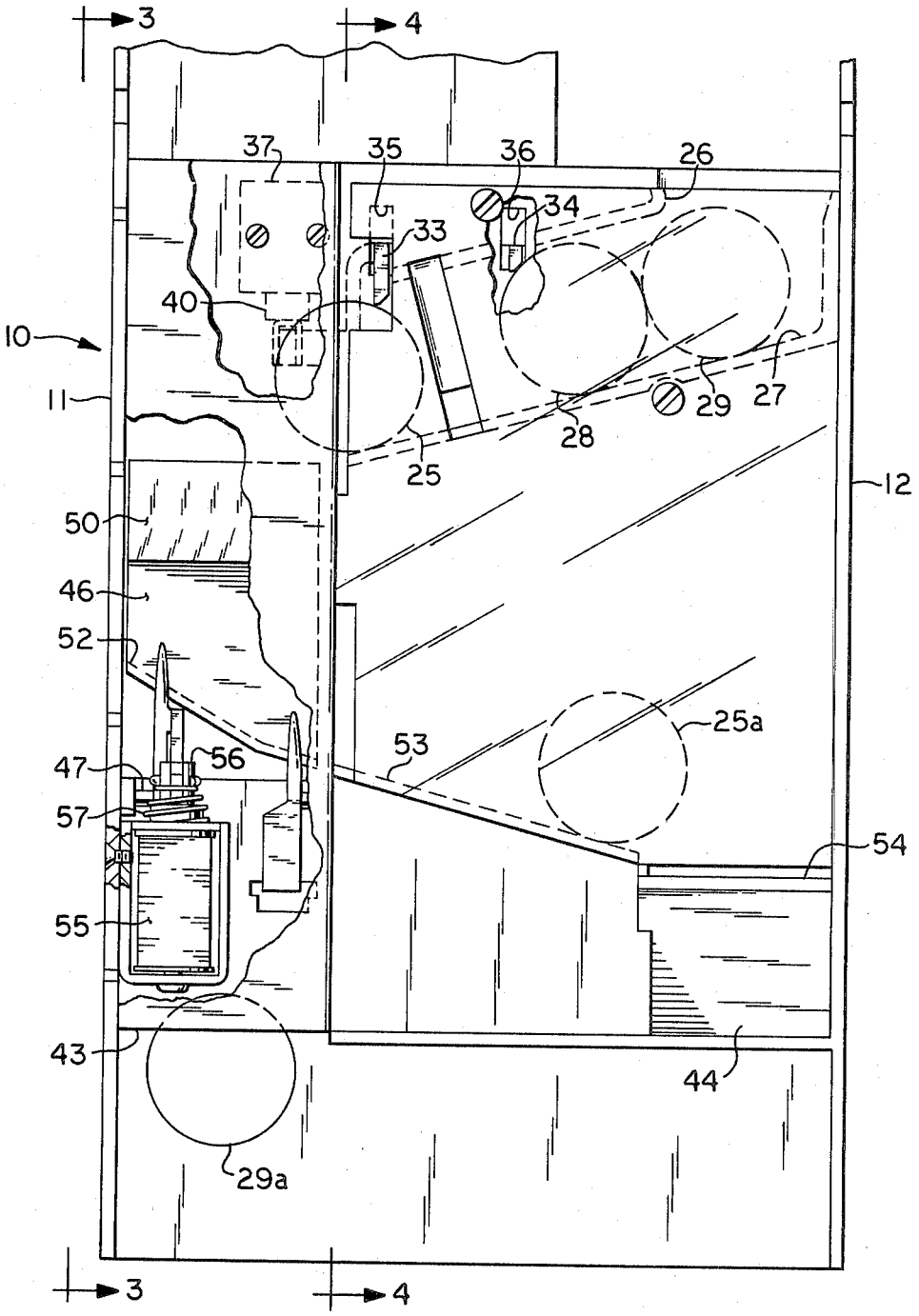
FIG. 1 is a fragmentary front view, partially cutaway, of the coin-handling assembly.
Figure 2:
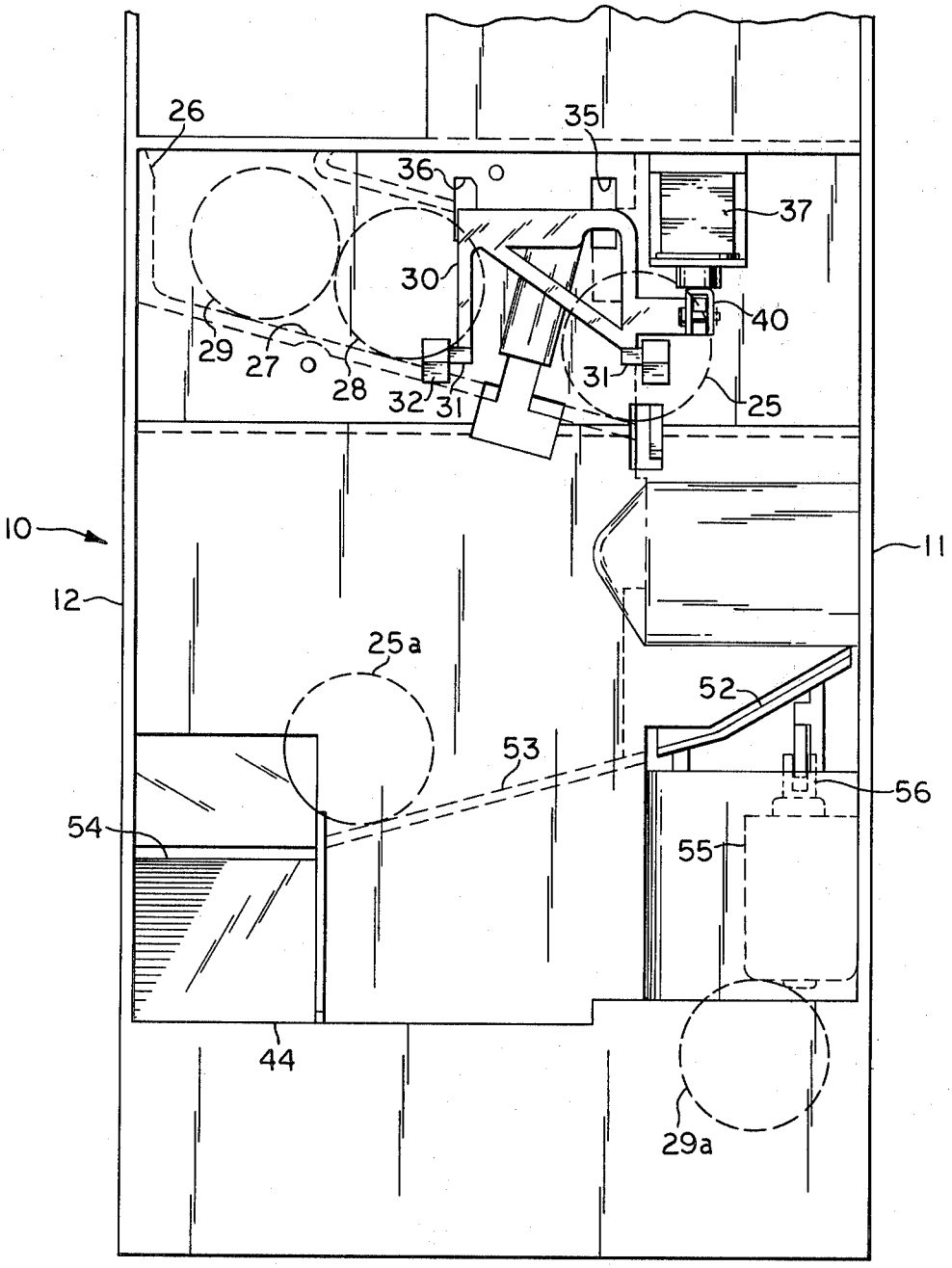
FIG. 2 is a fragmentary rear view of the assembly shown in FIG. 1.

Referring now by characters of reference to the drawings, it will be understood that the coin-handling assembly includes a housing 10 having side walls 11 and 12 interconnected by an intervening vertical wall 13 and a substantially hozizontal base wall 14. Attached to the front of the vertical wall 13, is a member 15 having a curvilinear rear wall 16 forming a coin passage 17 between the vertical wall 13 and the rear wall 16. Further, the member 15 includes spaced walls 20 and 21 forming a passage 22 therebetween, the purpose and function of the passage 22 being described later in detail. A plate 23 is also attached to the front of the vertical wall 13, the plate 23 and wall 13 being spaced at their upper ends to provide an escrow station 24 for receiving coins 25, 28 and 29 of one denomination, as for example a one dollar ($1.00) denomination coin. This escrow station 24 includes an entrance 26 and an inclined rail 27 formed on the plate 23 on which the coins 25, 28 and 29 are supported in an edge-to-edge row in successive adjacency.

An escrow-actuating means selectively retains the coins 25, 28 and 29 in the escrow station 24, and selectively releases the coins individually from the escrow station 24. This escrow-actuating means includes a body 30 having opposed legs 31 pivoted in pivot members 32 formed on the rear side of the vertical wall 13. The pivoted body 30 carries first and second fingers 33 and 34 extending through compatible slots 35 and 36 respectively formed in the vertical wall 13. As is best seen in FIG. 4, the first finger 33 is of a substantially hook formation.

Figure 3:
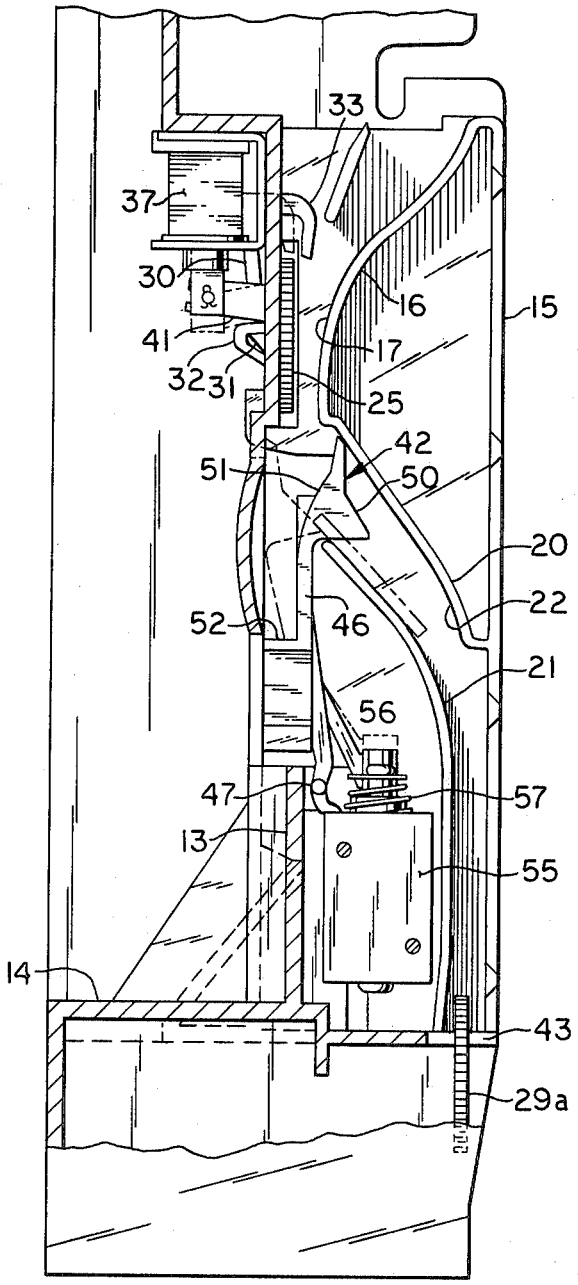
FIG. 3 is a fragmentary cross-sectional view taken on line 3—3 of FIG. 1.
Figure 4:
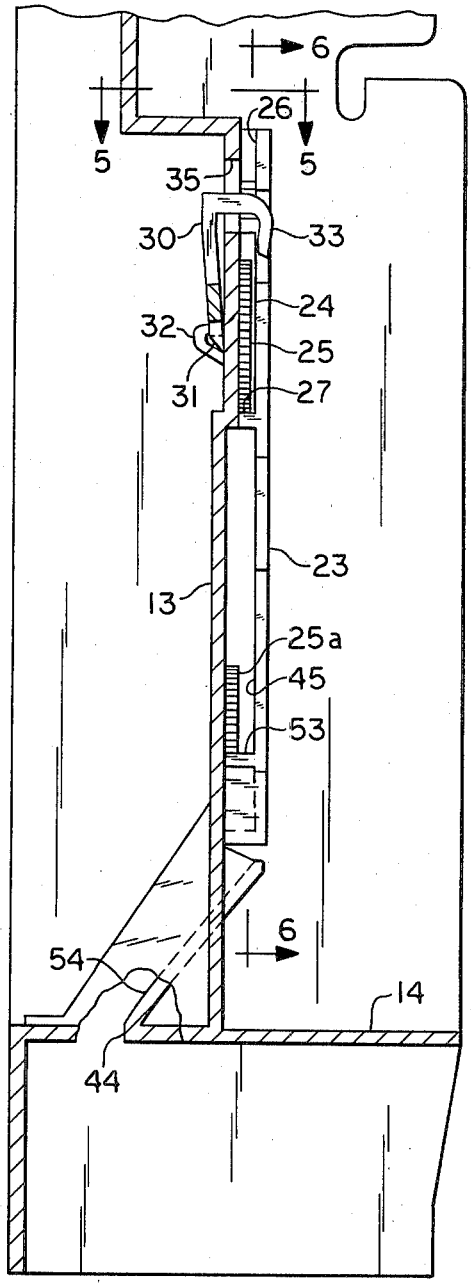
FIG. 4 is a fragmentary cross-sectional view taken on line 4—4 of FIG. 1.
Figure 5:
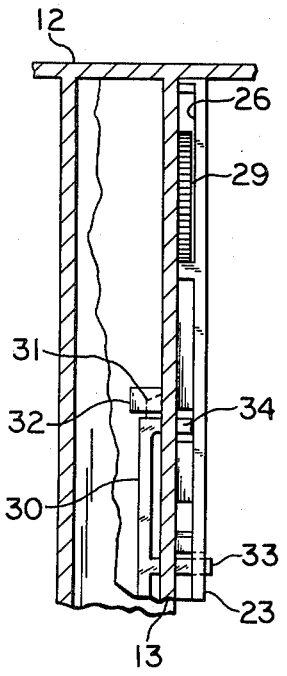
FIG. 5 is a fragmentary cross-sectional view taken on line 5—5 of FIG. 4.
Figure 6:
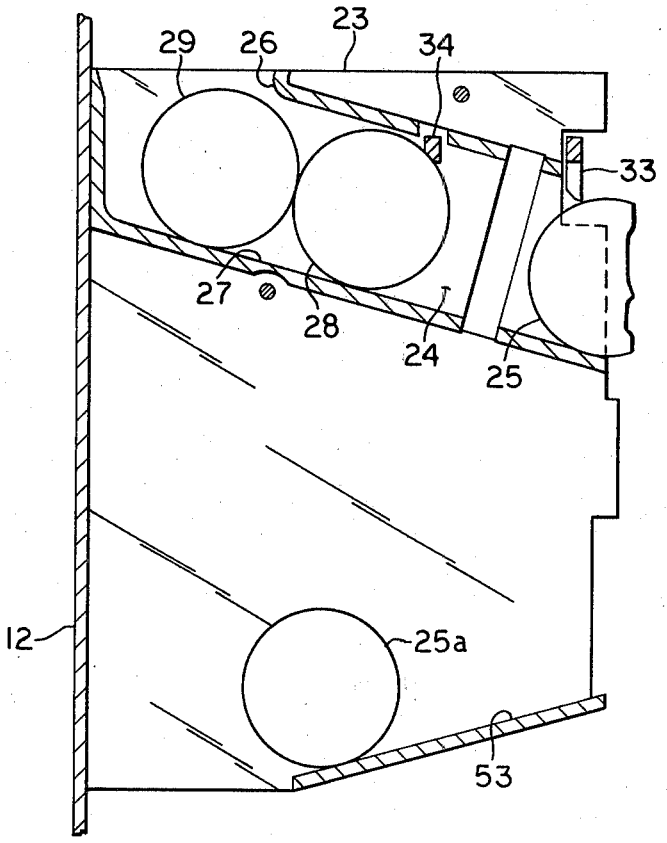
FIG. 6 is a fragmentary cross-sectional view taken on line 6—6 of FIG. 4.

The pivot means provided by the connection of legs 31 and pivot members 32, pivotally mounts the body 30 for selective movement to a first position as indicated by broken lines in FIG. 3 in which the first finger 33 is located in the path of the coins 25, 28 and 29 in the escrow station 24 and the second finger 34 is retracted out of the path of the coins 25, 28 and 29 in the escrow station, and for selective movement to a second position as indicated by the full lines in FIGS. 3 and 4 in which the first finger 33 is located out of the path of the coins 25, 28 and 29 in the escrow station 24 and the second finger 34 is extended into the path of the coins 25, 28 and 29 in the escrow station 24.

An actuator means selectively pivots the body 30 to the first and second positions described previously. This actuator means includes a solenoid 37 having a planar 40 pivotally mounted to an arm 41 formed on the body 30. When the solenoid 37 is energized, the plunger 40 pivots and moves the body 30 to the second position illustrated in full lines in FIG. 3, and when the solenoid 37 is de-energized, the plunger 40 pivots and moves the body 30 to the first position as illustrated in broken lines in FIG. 3.

After each coin 25, 28 and 29 is released from the escrow station 24 upon actuation of the pivoted body 30 of the escrow-actuating means, the coin is then selectively directed by a coin-diverting means 42 to either the coin return means 43 or the cash box means 44. The coin-diverting means 42 includes the passage 22 connecting the escrow station 24 to the cash box means 44, and another passage 45 connecting the escrow station 24 to the coin return means 43. The coin-diverting means 42 includes a coin-diverting member 46 located operatively between the escrow station 24 and each of the passages 22 and 45.

The coin-diverting member 46 is pivotally mounted by the pivot connection 47 for pivotal movement to a first position for diverting a coin from the escrow station 24 to the passage 45 leading to the cash box means 44, and for pivotal movement to another position for diverting the coin from the escrow station 24 to the passage 22 leading to the coin return means 43.

More particularly, the coin-diverting member 42 includes a shoulder 50 for deflecting a coin from the escrow station 24 to the coin return passage 22, when the coin-diverting member 42 is pivotally located in the position shown in broken lines in FIG. 3. Further, the coin-diverting member 46 includes a chute 51 for receiving and delivering a coin from the escrow station 24 to the other passage 45 when the coin-diverting member 46 is located in the pivoted position shown in full lines in FIG. 3. The bottom of the chute 51 is closed by an inclined rail 52 that is aligned with another inclined rail 53 formed on the plate 23. The rail 53 communicates with the passage portion 54 leading to the cash box means 44.

In addition, the coin-diverting means 42 includes a solenoid 55, constituting an actuator means, having a plunger 56 pivotally connected to the coin-diverting member 46 for selectively moving the coin-diverting member 46 to the positions described previously. For example, when the solenoid 55 is deenergized, the plunger 56 is moved under the loading of spring 57 to an extended position shown in broken lines in FIG. 3 to pivot the coin-diverting member 46 to the position also shown in broken lines in FIG. 3. In this position, the shoulder 50 deflects the coin from the escrow station 24 to the passage 22 leading to the coin return means 43. When the solenoid 55 is energized, the plunger 56 is retracted against the loading of spring 57 to the position shown in full lines in FIG. 3 so as to pivotally move the coin-diverting member 56 to the position also shown in full lines in FIG. 3. In this position, the coin from the escrow station 24 is received in the chute 51 and directed by rails 52 and 53 and passage portion 54 to the cash box means 44.

It is thought that the operation of the coin-handling assembly is apparent from the foregoing detailed description of parts, but for completeness of disclosure, such operation will be briefly described.

It will be assumed that the solenoids 37 and 55 are deenergized. Under these conditions, the body 30 of the escrow-actuating means is located in the position indicated by broken lines in FIG. 3 so that the finger 33 is located in the path of any coin deposited in the escrow station 24, and the finger 34 is retracted out of the path of any such coin in the escrow station 24. Also, the coin-diverting member 46 is located in the position shown in broken lines in FIG. 3 so that the shoulder 50 will engage and deflect any coin released from the escrow station 24 into the passage 22 leading to the coin return means 43.

Moreover, for the purpose of illustration, it will be assumed that the user deposits three coins 25, 28 and 29 of one denomination, i.e. one dollar coins. If the coins 25, 28 and 29 are valid, such coins 25, 28 and 29 will pass into the escrow station 24 and will be supported by the rail 27 preferably in edge-to-edge alignment and in successive adjacency. Because the escrow-actuating body 30 is located in its de-energized position, the coins 25, 28 and 29 will roll down the rail 27 until the lowermost first coin 25 engages the finger 33, thereby holding the three coins 25, 28 and 29 in the escrow station 24.

First, it will be assumed that the user decides not to vend any product from the machine, but desires the return of his coins, and therefore actuates the coin return. The solenoid 37 is energized so as to pivotally move the escrow-actuating body 30 to the position shown in full lines in FIG. 3 in which the finger 34 is moved into the path of and engagement with the coin 28 in the escrow station 24 so as to hold that coin 28 and any successive coin 29 while the finger 33 is moved out of engagement with the lowermost coin 25. Upon release of the lowermost coin 25 by the finger 33, such coin 25 will move along the rail 27 and will drop from the escrow station 24 into engagement with the shoulder 50 of the coin-diverting member 46, the shoulder 50 deflecting the coin into the passage 22 and thence through the coin return means 43.

After the lowermost coin 25 is delivered from the escrow station 24, the solenoid 37 is then de-energized so as to move the escrow-actuating body 30 back to its original position in which the finger 33 is located in the path of the remaining coins 28 and 29 in the escrow station 24, and the finger 34 is located out of the path of such coins 28 and 29. As the finger 34 disengages from the next adjacent coin 28, the two remaining coins 28 and 29 will then roll down the rail 27 until the coin 28 strikes the finger 33. The finger 33 is then holding the remaining two coins 28 and 29 in the escrow station 24.

The solenoid 37 is then again energized to provide another sequence of operation of the escrow-actuating body 30 so that each coin is released separately and individually from the escrow station 24, and delivered in the manner described to the coin return means 43. The user is returned his three original coins 25, 28 and 29 in this manner.

Now, it will be assumed that the user, after depositing the three valid coins 25, 28 and 29 of one denomination, decides to vend a product having a value of one dollar and twenty five cents ($1.25) by actuating the vend system. Under these conditions, the solenoid 37 is energized so as to pivotally move the escrow-actuating body 30 to the position described previously in which the finger 34 engages the second coin 28 so as to retain the second and third coins 28 and 29 in the escrow station 24 while the finger 33 disengages the lowermost first coin 25 and allows the first coin 25 to move out of the escrow station 24. Because the value of the item to be vended is more than the value of the first coin, the solenoid 55 is energized so as to move the coin-diverting member 46 to the position shown in full lines in FIG. 3 so that the coin represented by number 25*a* released from the escrow station 24 will move into the chute 51 into engagement with the inclined rail 52, along the aligned rail 53, through the passage portion 54, and to the cash box means 44.

Then, both solenoids 37 and 55 are de-energized. As described previously, when the solenoid 37 is de-energized, the escrow-actuating body 30 is pivotally moved to the position shown in broken lines in FIG. 3 in which the finger 33 moves back into the path of the remaining coins 28 and 29 in the escrow station 24, and the finger 34 is retracted out of engagement with the second coin 28, thereby allowing the second coin 28 to move down the rail 27 and into engagement with the finger 33 so that the second and third coins 28 and 29 are then retained in the escrow station 24 by the finger 33.

Again, the solenoid 37 is energized so as to release the second coin 28 from the escrow station 24 and to retain the third coin 29 in the escrow station 24. Because the value of the second coin 28 released, together with the value of the first coin 25 previously released, exceeds the price of the vended item, the solenoid 55 is again actuated and moved to a position previously described so that the second coin 28 passes into the chute 51 of the coin-diverting member 46, into engagement with the rails 52 and 53, and thence through the passage portion 54 to the cash box means 44. Change is returned to the user from coin storage tubes (not shown) in the amount of the difference between the price of the item vended and the value of the two coins 25 and 28 received in the cash box means 44.

Again, after the second coin 28 is accepted, the solenoids 37 and 55 are again de-energized. The escrow-actuating body 30 is pivotally moved to the position so as to retract the finger 34 out of engagement with the third coin 29 while the finger 33 is moved back into the path of the coin 29 remaining in the escrow station 24. The third coin 29 then moves along the rail 27 into engagement with the finger 33 for retention in the escrow station 24.

Because the value of this third coin 29 in the escrow station 24 exceeds the price of the item vended by an amount equal to the value of the coin 29 in the escrow station 24, this third coin 29 is returned to the user instead of being accepted by the assembly. Under these conditions, the solenoid 37 is again energized to move the finger 33 of the escrow-actuating body 30 out of engagement with the last and third coin 29 so that this coin 29 is delivered from the escrow station 24. The solenoid 55 remains de-energized so that the coin-diverting member 46 is located in the position shown in broken lines in FIG. 3 in which the third coin represented by reference member 29*a* is delivered from the escrow station 24, strikes the shoulder 50, and is deflected into the passage 22 leading to the coin return means 43.

We claim as our invention:

1. A coin-handling assembly, comprising:

(a) a coin escrow station for receiving coins of one denomination, (b) escrow-actuating means selectively retaining the coins in the escrow station, and selectively releasing the coins individually from the escrow station, (c) a coin return means for returning the coins, (d) a cash box means for accepting the coins, (e) a coin-diverting means selectively engaging each coin when released from the escrow station, and selectively directing each coin to either the coin return means or the cash box means, (f) the escrow station including means for supporting the coins in successive adjacency, and for delivering the coins to the coin-diverting means when released by the coin escrow actuating means, and (g) the escrow-actuating means including:

1. first and second fingers selectively movable into and out of the path of the coins in the escrow station, and 2. actuator means selectively moving the first finger into engagement with a lowermost coin, and the second finger out of engagement with the coins for holding the coins in the escrow station, and the actuator means selectively moving the first finger out of engagement with the lowermost coin for releasing the lowermost coin for delivery to the coin-diverting means, and selectively moving the second finger into engagement with a next adjacent coin for holding the coins in the escrow station while the first finger releases the said lowermost coin.

2. A coin-handling assembly as defined in claim 1, in which:

(h) the actuator means selectively moves the second finger out of engagement with the coins and selectively moves the first finger into the path of the coin after release of the lowermost coin for allowing the said next adjacent coin to move to and engage the first finger for holding the remaining coins in the escrow station.

3. A coin-handling assembly as defined in claim 2, in which:

(i) the escrow-actuating means includes:

1. a body carrying the first and second fingers, 2. pivot means pivotally mounting the body for selective movement to a first position in which the first finger is in the path of the coins in the escrow station and the second finger is out of the path of the coins in the escrow station, and for selective movement to a second position in which the first finger is out of the path of the coins in the escrow station and the second finger is in the path of the coins in the escrow station, and 3. the actuator means selectively pivoting the body to the first and second positions.

4. A coin-handling assembly as defined in claim 3, in which:

(j) the actuator means is a solenoid connected to the body for moving the body to one position when energized and to the other position when de-energized.

5. A coin-handling assembly, comprising:

(a) a coin escrow station for receiving coins of one denomination, (b) escrow-actuating means selectively retaining the coins in the escrow station, and selectively releasing the coins individually from the escrow station, (c) a coin return means for returning the coins, (d) a cash box means for accepting the coins, (e) a coin-diverting means selectively engaging each coin when released from the escrow station, and selectively directing each coin to either the coin return means or the cash box means, (f) the escrow station including means for supporting the coins in successive adjacency, and for delivering the coins to the coin-diverting means when released by the escrow-actuating means, (g) the escrow-actuating means including:

1. first and second fingers selectively movable into and out of the path of the coins in the escrow station, and 2. actuator means selectively moving the first finger into engagement with a lowermost coin, and the second finger out of engagement with the coins for holding the coins in the escrow station, and the actuator means selectively moving the first finger out of engagement with the lowermost coin for releasing the lowermost coin for delivery to the coin-diverting means, and selectively moving the second finger into engagement with a next adjacent coin for holding the remaining coins in the escrow station while the first finger releases the said lowermost coin, and (h) the coin-diverting means including:

1. a first passage connecting the escrow station to the cash box means, 2. a second passage connecting the escrow station to the coin return means, 3. a coin-diverting member between the escrow station and each of the first and second passages, and 4. means movably mounting the coin-diverting member for movement to a first position for diverting a coin from the escrow station to the first passage, and for movement to a second position for diverting a coin from the escrow station to the second passage.

6. A coin-handling assembly as defined in claim 5, in which:

(i) the actuator means selectively moves the second finger out of engagement with the coin, and selectively moves the first finger into the path of the coins after release of the lowermost coin for allowing the said next adjacent coin to move to and engage the first finger, (j) the escrow-actuating means includes:

1. a body carrying the first and second fingers, 2. pivot means pivotally mounting the body for selective movement to a first position in which the first finger is in the path of the coins in the escrow station and the second finger is out of the path of the coins in the escrow station, and for selective movement to a second position in which the first finger is out of the path of the coins in the escrow station and the second finger is in the path of the coins in the escrow station, and 3. the actuator means selectively pivoting the body to the first and second positions, (k) the coin-diverting member includes:

1. a shoulder for deflecting a coin from the escrow station to one of said passages, and 2. a chute for receiving and delivering a coin from the escrow station to the other of said passages.

* * * * *

UNITED STATES PATENT AND TRADEMARK OFFICE

CERTIFICATE OF CORRECTION

PATENT NO. : 4,399,902

DATED : August 23, 1983

INVENTOR(S) : Charles R. Holland; Carl L. Vogt

It is certified that error appears in the above-identified patent and that said Letters Patent are hereby corrected as shown below:

Column 4:

Line 12, delete "56" and insert --46--.

Column 6:

Line 9, delete "member" and insert --number--.

Signed and Sealed this

*Eighteenth* Day of *October 1983*

[SEAL]

*Attest:*

GERALD J. MOSSINGHOFF

*Attesting Officer*

*Commissioner of Patents and Trademarks*